US011768052B2

(12) United States Patent
Barnett

(10) Patent No.: US 11,768,052 B2
(45) Date of Patent: Sep. 26, 2023

(54) REPEATING BREAK-ACTION CROSSBOW

(71) Applicant: Barnett Outdoors, LLC, Tarpon Springs, FL (US)

(72) Inventor: David A. Barnett, Tampa, FL (US)

(73) Assignee: Barnett Outdoors, LLC, Tarpon Springs, FL (US)

( * ) Notice: Subject to any disclaimer, the term of this patent is extended or adjusted under 35 U.S.C. 154(b) by 0 days.

(21) Appl. No.: 17/745,961

(22) Filed: May 17, 2022

(65) Prior Publication Data

US 2022/0364820 A1 Nov. 17, 2022

Related U.S. Application Data

(60) Provisional application No. 63/189,352, filed on May 17, 2021.

(51) Int. Cl.
*F41A 9/61* (2006.01)
*F41B 5/12* (2006.01)
*F41B 5/14* (2006.01)

(52) U.S. Cl.
CPC ..... *F41B 5/126* (2013.01); *F41B 5/1461* (2013.01); *F41A 9/61* (2013.01)

(58) Field of Classification Search
CPC ..... F41B 5/12; F41B 5/126; F41B 5/1469; F41B 11/50; F41A 9/61
USPC ..... 124/25, 25.5, 80
See application file for complete search history.

(56) References Cited

U.S. PATENT DOCUMENTS 918,444 A * 4/1909 Griffith ..... F41B 5/126 124/52
2,516,341 A * 7/1950 Raffeis ..... F41B 5/126 124/35.1
3,125,998 A * 3/1964 Stevens ..... F41B 5/126 125/41
3,739,765 A * 6/1973 Moore ..... F41B 5/12 124/44.6
4,565,182 A * 1/1986 Barnett ..... F41B 5/12 124/48
4,662,345 A * 5/1987 Stephens ..... F41B 5/12 124/40

(Continued)

OTHER PUBLICATIONS

International Search Report and Written Opinion dated Aug. 10, 2022, from Applicant's counterpart International Patent Application No. PCT/US2022/029599.

(Continued)

*Primary Examiner* — John E Simms, Jr.
(74) *Attorney, Agent, or Firm* — Jones Walker LLP

(57) ABSTRACT

A break action pistol crossbow having a repeating capability. The crossbow has a loading chamber configured to house a plurality of bolts. A biasing mechanism is disposed within the loading chamber. The crossbow has a forward retainer positioned at the front of a flight rail and a rear retainer positioned at the back of the flight rail. The bowstring is configured to be drawn over a bolt loaded into the chamber. As the bowstring travels over the bolt, the biasing mechanism presses the bolt against the bowstring. When the bowstring clears the bolt, the force applied onto the bolt by the biasing mechanism presses the leading end of the bolt against the retaining bridge and presses the trailing end of the bolt against retaining brush. In this manner, the bolt is aligned with the flight rail.

16 Claims, 13 Drawing Sheets

(56) References Cited

U.S. PATENT DOCUMENTS

| | | | | |
|---|---|---|---|---|
| 5,215,069 | A * | 6/1993 | Liu | F41B 5/12 124/40 |
| 5,911,216 | A | 6/1999 | Killian | |
| 6,868,845 | B1 * | 3/2005 | Moore | F41B 5/10 124/25 |
| 8,991,374 | B1 * | 3/2015 | Conkel | F41B 7/006 124/44.5 |
| 9,528,792 | B1 * | 12/2016 | Chang | F41B 5/1469 |
| 9,568,269 | B1 * | 2/2017 | Chang | F41B 5/126 |
| 9,644,919 | B1 * | 5/2017 | Liu | F41B 5/1403 |
| 9,746,278 | B1 | 8/2017 | Chang | |
| 9,766,032 | B1 | 9/2017 | Chang | |
| 10,378,853 | B1 * | 8/2019 | Liu | F41B 5/1469 |
| 10,495,403 | B1 * | 12/2019 | Liu | F41B 5/143 |
| 2004/0083637 | A1 * | 5/2004 | Sands | F41C 33/001 42/85 |
| 2008/0141989 | A1 * | 6/2008 | Ogawa | F41B 5/12 124/25 |
| 2015/0233666 | A1 * | 8/2015 | Rodich | F41B 5/126 124/52 |
| 2017/0038175 | A1 | 2/2017 | Barnett | |
| 2021/0348875 | A1 * | 11/2021 | Bednar | G06F 11/3409 |

OTHER PUBLICATIONS

Co-pending U.S. Appl. No. 17/727,086, filed Apr. 22, 2022, titled "Repeating Toy Crossbow."

* cited by examiner

REPEATING BREAK-ACTION CROSSBOW

CROSS-REFERENCE TO RELATED APPLICATION

This application claims the benefit of, and priority to, U.S. Provisional Patent Application No. 63/189,352, filed on May 17, 2021, which is incorporated herein by reference in its entirety.

FIELD OF THE INVENTION

This invention relates to weapons. More specifically, it relates to a repeating break-action pistol crossbow.

BACKGROUND

Current marketplace has several models of pistol crossbows that shoot short arrows, commonly referred to as "bolts." One type of a pistol crossbow is known as a break-action crossbow, originally designed by the company named BARNETT and sold under the COMMANDO trademark. A break-action crossbow generally functions in the following manner: a cocking mechanism draws a bowstring from its rest position to its fully drawn position. The cocking mechanism involves at least one longitudinal arm terminating in a hook, wherein the arm is pivotally attached to the rear stock portion of the crossbow. To cock the crossbow, a user rotates the rear stock in a downward direction relative to the body of the crossbow. This breaking motion causes the cocking arm to longitudinally translate along the body of the crossbow. As the cocking arm moves back relative to the crossbow body, the cocking hook draws the bowstring toward its cocked position.

A major flaw of the currently known break-action pistol crossbows is that the user must manually position a single bolt onto the flight rail after cocking the crossbow and then repeat this task for each subsequent shot. The step of manually placing a bolt onto the flight rail, while maintaining a cocked crossbow in a horizontal orientation, is detrimental to the user experience because it reduces the rate at which the user can fire consecutive shots, requires the user to lose aim after every shot, and requires the user to keep track of the whereabouts of the spare bolts and to manually reach for those bolts for reloading the crossbow after every shot. Furthermore, in the currently known pistol crossbows, the cocking arm is exposed and, therefore, is prone to damage. Moreover, the longitudinal slot, along which the cocking arm slides, is prone to getting clogged with debris.

Accordingly, what is needed is a repeating crossbow capable of storing multiple preloaded bolts and having a concealed cocking mechanism that is configured to automatically load a bolt onto the flight rail after the crossbow is cocked.

BRIEF DESCRIPTION OF THE DRAWING VIEWS

DETAILED DESCRIPTION OF SELECTED EMBODIMENTS

In the following detailed description of the preferred embodiment, reference is made to the accompanying drawings, which form a part hereof, and within which specific embodiments are shown by way of illustration by which the invention may be practiced. It is to be understood that other embodiments may be utilized and structural changes may be made without departing from the scope of the invention.

Disclosed herein is a repeating break-action pistol crossbow including a body containing a chamber configured to house one or more projectiles with a biasing mechanism configured to exert an upward force on the one or more projectiles within the chamber. In certain embodiments, the biasing mechanism may include a bolt lever and a biasing element configured to bias the bolt lever in an upward direction. A forward retainer is configured to retain a forward end of a projectile on a flight rail of the body. A rearward retainer is configured to retain a rearward end of the projectile on the flight rail. In certain embodiments, the forward retainer includes a retaining bridge disposed near a forward end of the crossbow body and the rearward retainer includes a retaining brush disposed on an underside of a trigger hood. FIGS. 1-14 illustrate one embodiment of the repeating break-action pistol crossbow of the present invention.

Figure 1:
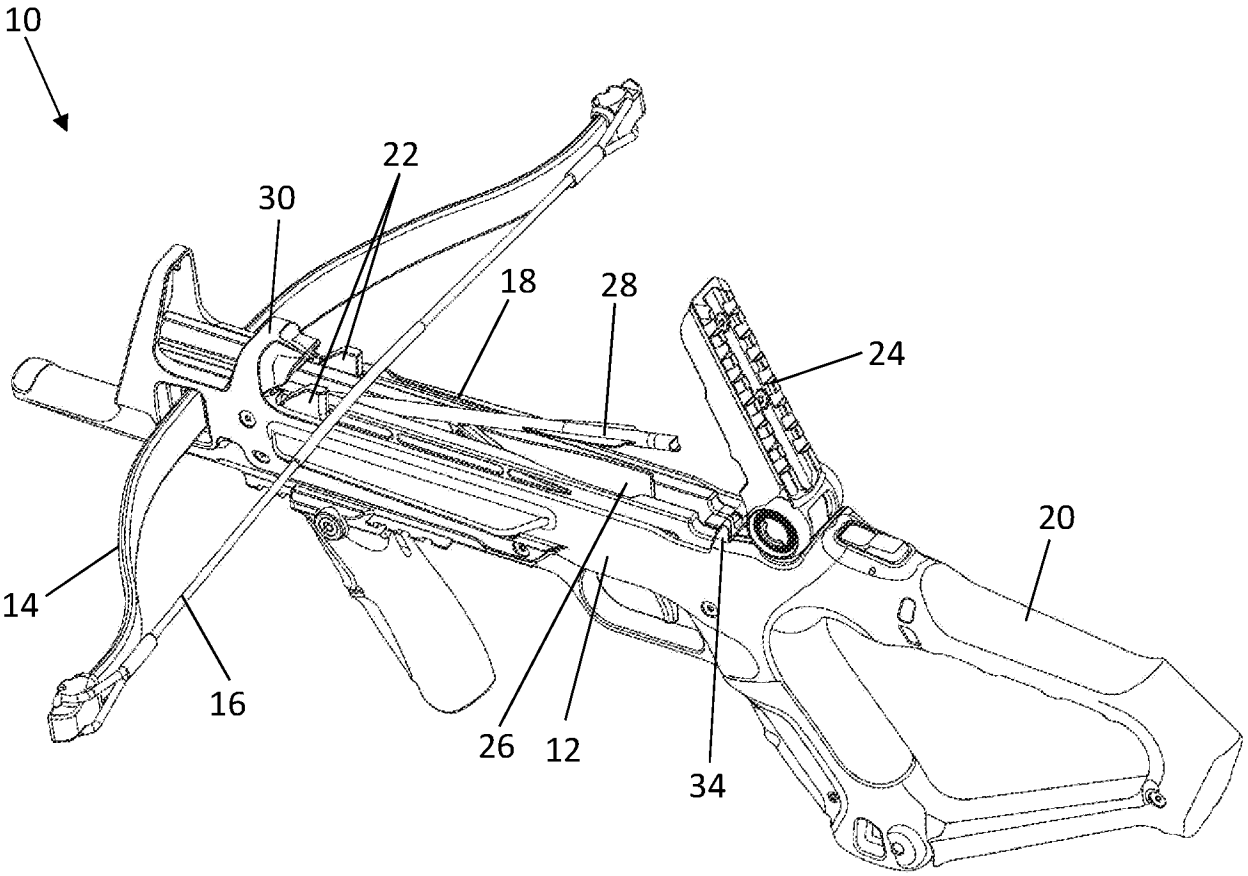
FIG. 1 is a perspective view of a bolt being loaded into a loading chamber of a crossbow of the present invention.

With reference to FIG. 1, repeating break-action pistol crossbow 10 includes body 12, prod 14, and bowstring 16. The body 12 includes flight rail 18, which is a top surface of the body 12 along which bowstring 16 travels when crossbow 10 is being cocked and shot. FIG. 1 depicts a default position of crossbow 10 in which the crossbow is un-cocked. In this default position, cocking lever 20 (rear stock) is in a closed position. Crossbow 10 also includes cocking hooks 22 protruding above flight rail 18 of the crossbow body 12.

In the default position, the cocking hooks 22 are positioned in front of the resting position of the bowstring 16.

Trigger hood 24 is secured to crossbow body 12. Chamber 26 is disposed within crossbow body 12 below flight rail 18. Chamber 26 is configured to house one or more projectiles 28 (also referred to as bolts 28). Placing trigger hood 24 in an open position as shown in FIG. 1 provides access to chamber 26. The open position of trigger hood 24 may result from a movement of trigger hood 24 in any direction and in any way, such as lateral rotation relative to the crossbow body 12, sliding rearward relative to the crossbow body 12, or otherwise moving away from the opening of the loading chamber 26. With the trigger hood 24 moved away from the opening of the loading chamber 26, bolts 28 can be loaded into the loading chamber 26. The bolts 28 are loaded with a leading portion (i.e., the point) first, such that the point of each bolt slides under the un-cocked bowstring and a forward retainer, which is configured to retain the leading portion of the projectile 28 in alignment with the flight rail 18. In one embodiment, the forward retainer is a retaining bridge 30 near a forward end of crossbow body 12.

A biasing mechanism is disposed within loading chamber 26. When bolts 28 are being loaded, a sufficient force must be applied onto each bolt 28 to overcome the biasing force of the biasing mechanism. The biasing mechanism may be configured to bias the bolts 28 housed within loading chamber 26 in an upward direction toward flight rail 18. With bolts 28 housed within loading chamber 26, the biasing mechanism exerts an upward force on bolts 28, thereby pressing the leading end of the top bolt 28 against the bowstring 16. In certain embodiments, the biasing mechanism includes a spring-loaded bolt lever (depicted in FIGS. 6-11) disposed within loading chamber 26.

Referring again to FIG. 1, a rearward retainer is configured to secure the trailing ends of the bolts 28 after they have been loaded into the loading chamber 26. In one embodiment, the rearward retainer includes trigger hood 24. To secure the trailing ends of the bolts 28 after they have been loaded into the loading chamber 26, the trigger hood 24 is rotated back over the bolts 28 into its firing position, as depicted in FIG. 3. In one embodiment, the trigger hood is configured to lock into its firing position, via a spring-loaded release button 31 (shown in FIG. 2). In one embodiment, a spring-loaded plunger may be positioned below the rotating portion of the trigger hood 24 to hold the trigger hood 24 in tension and remove any rattle or movement therefrom.

Figure 2:
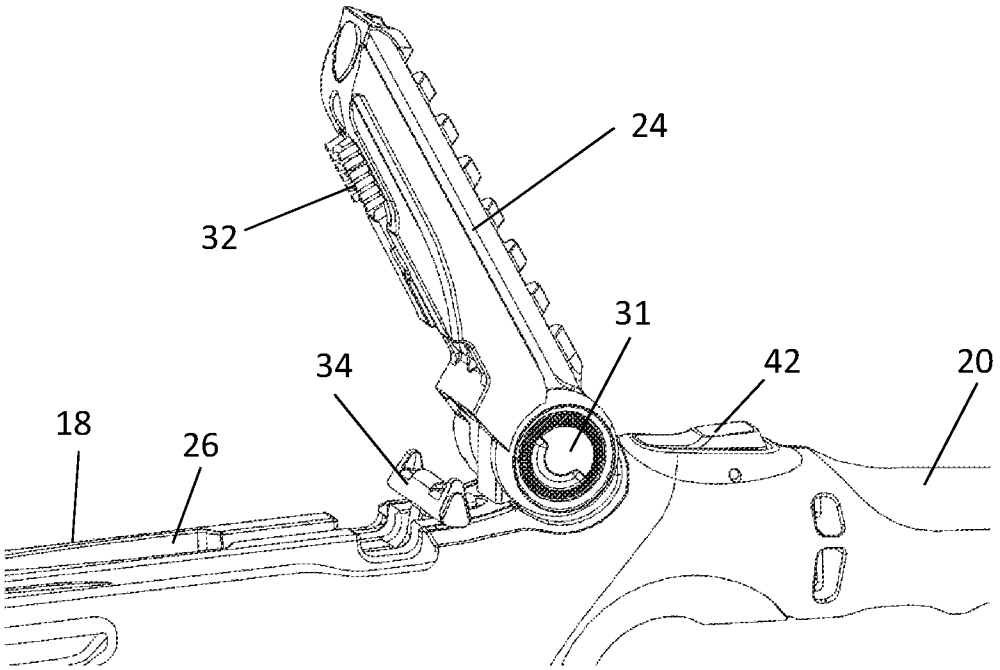
FIG. 2 is a perspective view of a trigger hood of the crossbow, with the trigger hood in an open position.
Figure 3:
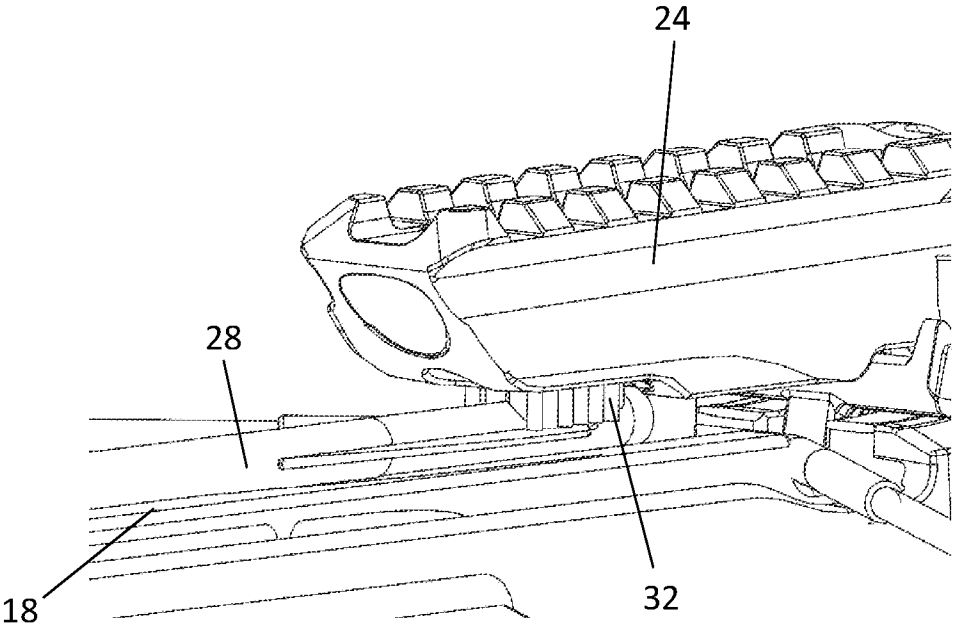
FIG. 3 is perspective view of the trigger hood in a closed position.

In certain embodiments, the rearward retainer further includes a retaining brush 32 disposed on the underside of trigger hood 24, as shown in FIGS. 2 and 3. FIG. 2 shows the trigger hood 24 in the open position, while FIG. 3 shows the trigger hood 24 in the closed position (i.e., the firing position). In the closed position of the trigger hood 24 (shown in FIG. 3), the retaining brush 32 is configured to contact the trailing portion of the bolt 28, specifically the fletching of bolt 28. The force exerted onto the bolt 28 by the bolt lever presses the fletching of the bolt 28 against the retaining brush 32 of the trigger hood 24. In this manner, the retaining brush 32 immobilizes the trailing portion of bolt 28 in a proper alignment relative to the flight rail 18.

FIG. 2 further depicts a spring-loaded safety catch 34. The biasing force of the spring urges the safety catch 34 toward an engaged position, in which the safety catch 34 prevents the trigger 36 (shown in FIG. 4) from being pulled. When the trigger hood 24 is in the open position (shown in FIG. 2), the safety catch 34 automatically immobilizes the trigger 36, thereby preventing the user from firing the crossbow 10. When the trigger hood 24 is transitioned into the closed, firing position (shown in FIG. 3), the safety catch 34 can be placed in a disengaged position, which allows the user to pull the trigger 36 and fire the crossbow 10.

Figure 4:
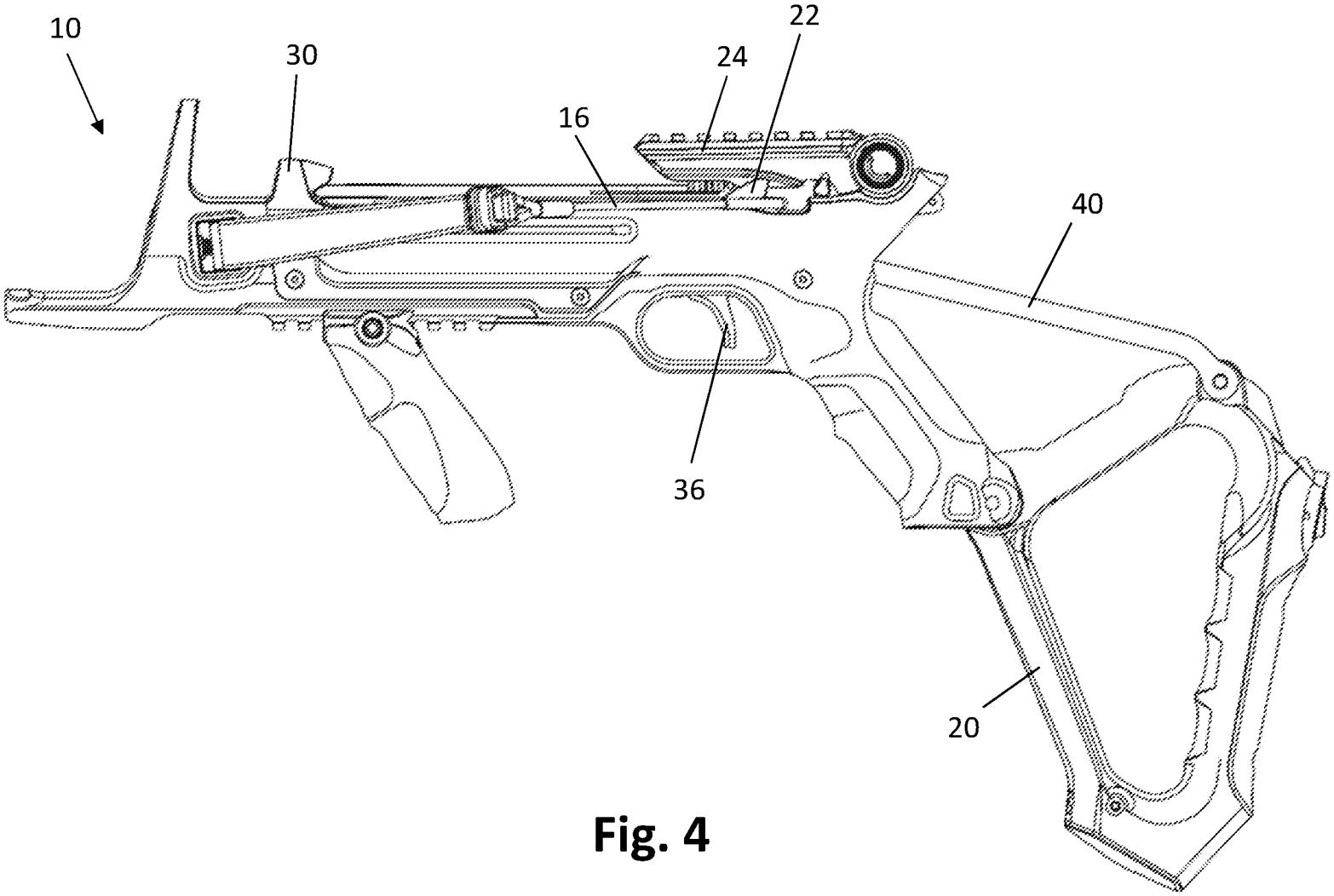
FIG. 4 is a side view of the crossbow with a cocking lever in a rotated position.

Referring now to FIG. 4, the cocking lever 20 may be rotated toward a fully rotated position. The cocking lever 20 is pivotally attached to the crossbow body 12, and the cocking arms 40 are pivotally attached to the cocking lever 20. The cocking hooks 22 are disposed on the terminal ends of the cocking arms 40. As the cocking lever 20 rotates downward, the cocking arms 40, along with the cocking hooks 22 disposed thereon, move back relative to the crossbow body 12. FIG. 4 depicts that, when the cocking lever 20 is in the fully rotated position, the cocking hooks 22 draw the bowstring 16 past the trigger latch. At this point, the trigger latch retains the bowstring 16 in the cocked position until the trigger 36 is pulled.

Figure 5:
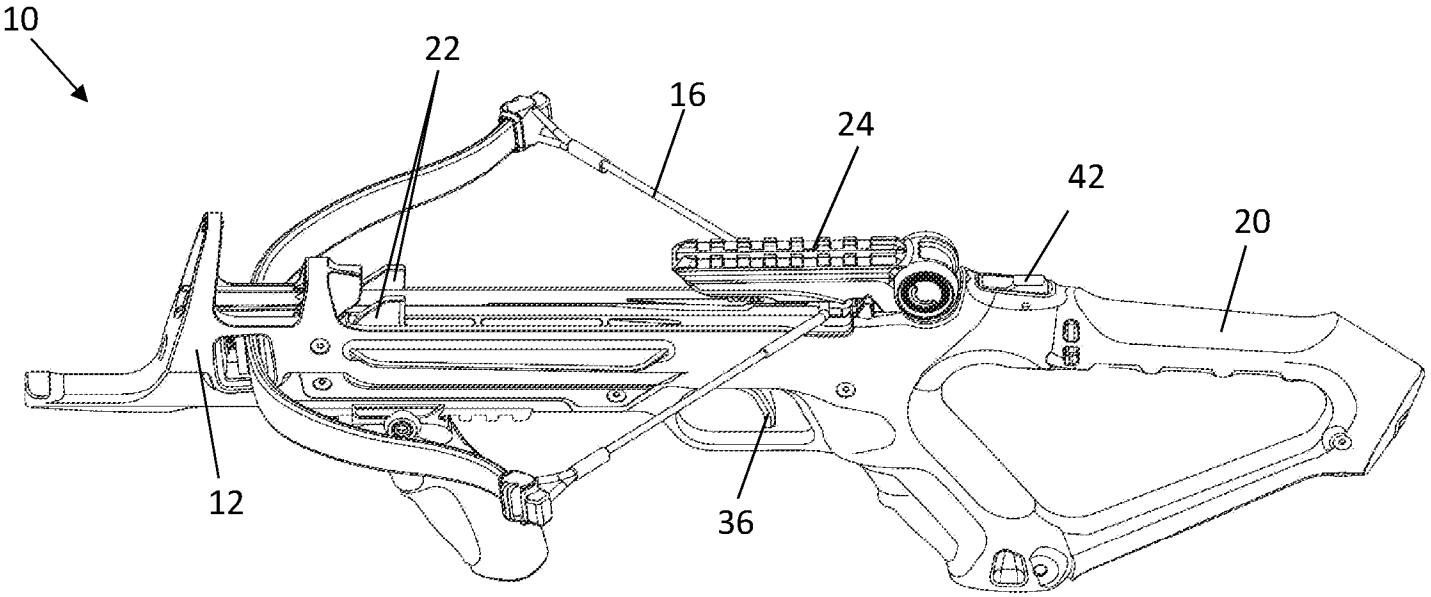
FIG. 5 is a perspective view of the crossbow with the cocking lever in a closed position and a bowstring in a cocked position.

FIG. 5 shows crossbow 10 in the cocked position, in which the cocking lever 20 is returned to its initial closed position and cocking hooks 22 are returned to their initial position at the forward end of crossbow body 12. A locking catch 42 is configured to retain the cocking lever 20 in this closed position. A user must disengage the locking catch 42 to operate the cocking lever 20. FIG. 5 also shows that the cocking arms 40, and the slots disposed on the crossbow body 12 along which the cocking arms 40 slide, are fully concealed. In this manner the cocking arms are protected from damage, and their slots are shielded from debris.

Figure 6:
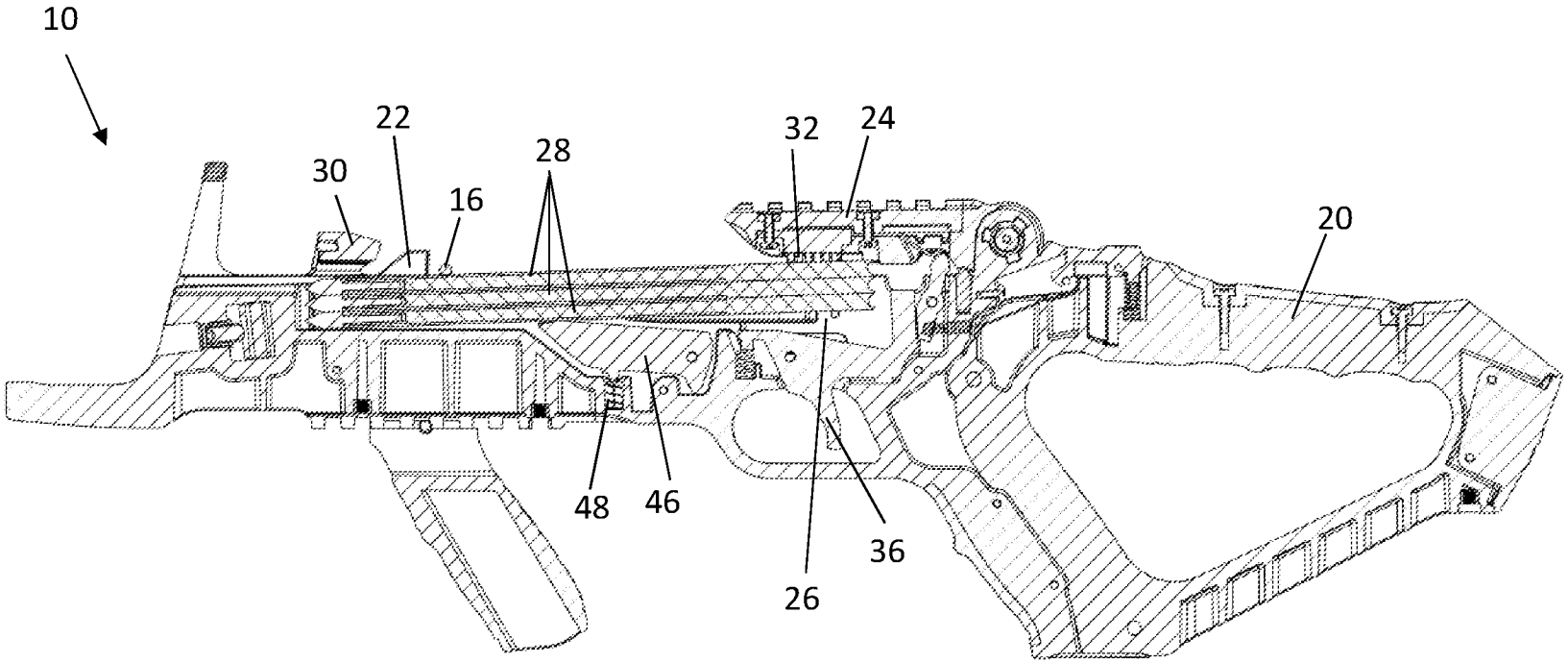
FIG. 6 is a cross-sectional side view of the crossbow in an uncocked position with three bolts loaded into the loading chamber.

FIGS. 6-10 depict a sequence of cocking a loaded crossbow 10 and shooting a bolt 28. FIG. 6 depicts the pistol crossbow 10 with three bolts 28 loaded into the loading chamber 26. The cocking lever 20 is in its closed position, and the cocking hooks 22 and the bowstring 16 are positioned at the front end of the crossbow 10. The bolt lever 46 within the chamber 26 applies an upward force onto the three bolts 28 within the chamber 26 in response to the biasing force exerted by spring 48 on bolt lever 46. In the un-cocked position, a leading portion of the top bolt 28 engages the bowstring 16 and a trailing portion of the top bolt 28 engages the retaining brush 32 underneath the trigger hood 24.

Figure 7:
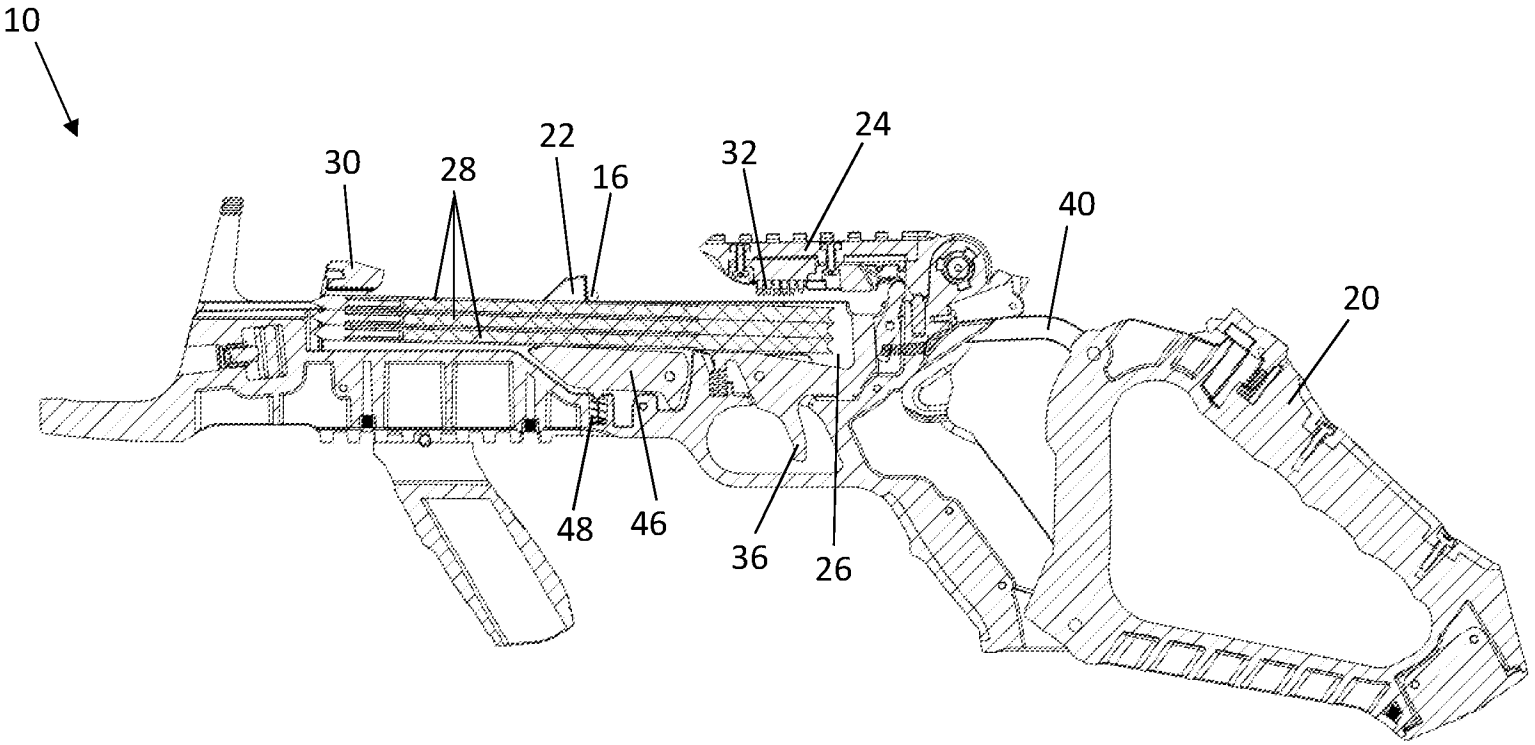
FIG. 7 is a cross-sectional side view of the crossbow with the cocking lever in a partially rotated position and a pair of cocking hooks drawing the bowstring over the bolts housed within the loading chamber.

Next, FIG. 7 depicts the cocking lever 20 initiating its transition toward the fully rotated position. The rotation of the cocking lever 20 pulls back the cocking arm 40 and, therefore, the cocking hooks 22 affixed thereto. The cocking hooks 22 engage the bowstring 16 and pull the bowstring 16 over the bolts 28 loaded in the loading chamber 26. In this configuration, the bolt lever 46 within the chamber 26 is pressing the leading ends of the bolts 28 against the retaining bridge 30 and is pressing the middle portion of the bolts 28 against the bowstring 16. As the bowstring 16 travels over the loaded bolts 28, the bowstring 16 pushes the trailing ends of the bolts 28 downward, away from the retaining brush 32 of the trigger hood 24.

Figure 8:
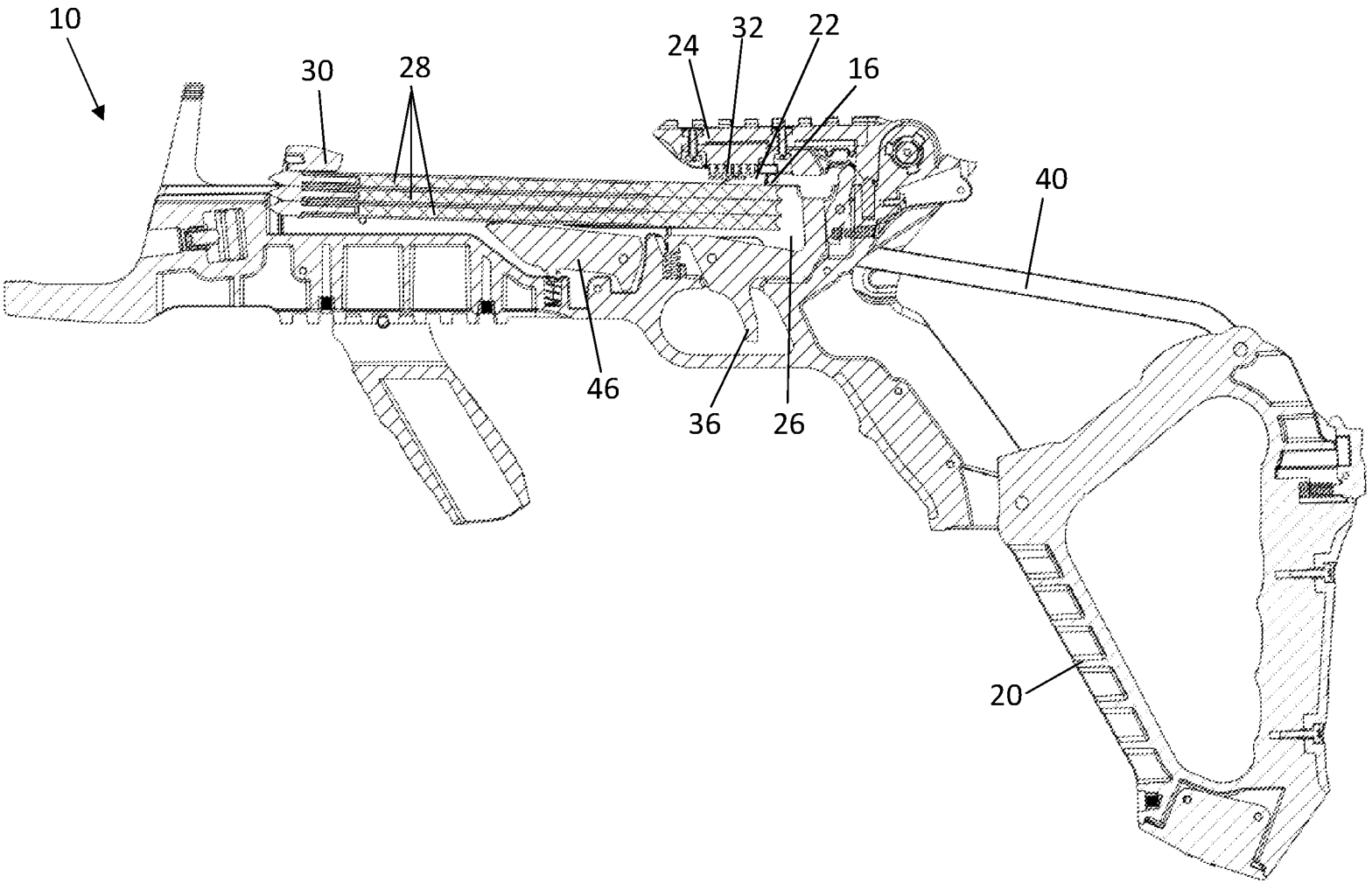
FIG. 8 is a cross-sectional side view of the crossbow with the cocking lever in an almost fully rotated position and the cocking hooks drawing back the bowstring over the trailing end of the top bolt.

Next, FIG. 8 depicts the cocking lever 20 approaching its fully rotated position. The cocking hooks 22 continue to slide in a rearward direction relative to the crossbow body 12, continuing to draw the bowstring 16 over the bolts 28. FIG. 8 depicts that the bolt lever 46 within the chamber 26 is pressing the leading ends of the bolts 28 against the retaining bridge 30 and is pressing the trailing ends of the bolts 28 against the bowstring 16. As the cocking lever 20 is rotated further, the bowstring 16 will clear the bolts 28, and the biasing force exerted onto the bolts 28 by the bolt lever 46 will press the trailing ends of the bolts 28 against the retaining brush 32 of the trigger hood 24, as depicted in FIG. 9.

Figure 9:
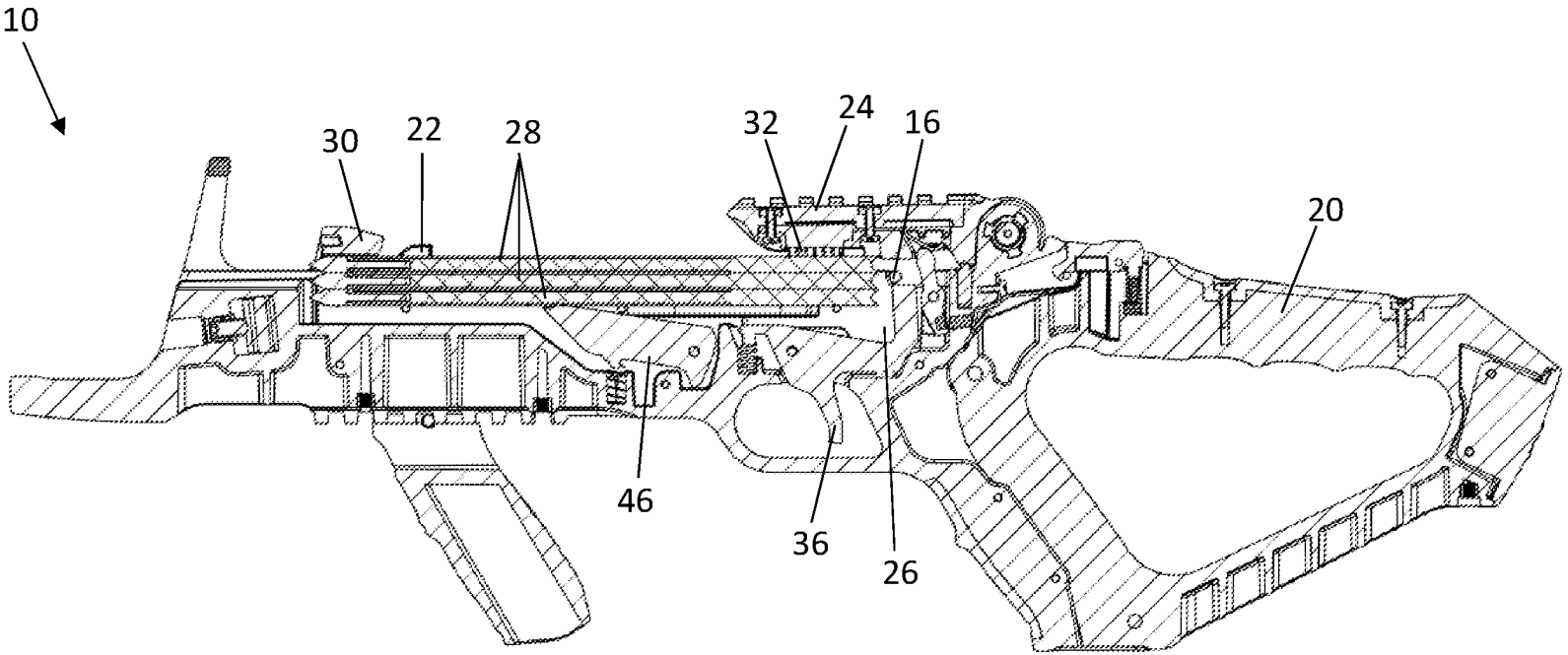
FIG. 9 is a cross-sectional side view of the crossbow with the cocking lever returned to its closed position and the cocking hooks returned to the front of the flight rail after the bowstring is placed in the cocked position.

FIG. 9 depicts that, after the bowstring 16 is in the cocked position, the user will return the cocking lever 20 to its closed position, thereby moving the cocking hooks 22 to the forward side of the crossbow body 12, away from the path of the bowstring 16. At this point, the crossbow 10 is cocked and ready to be fired. The bolt lever 46 within the chamber 26 presses the leading end of the top bolt 28 against the retaining bridge 30 and the trailing end of the top bolt against the retaining brush 32 of the trigger hood 24. In this manner, the top bolt 28 is aligned with the flight rail 18. When the trigger 36 is pulled, the bowstring 16 is released from behind the trigger latch. As the bowstring 16 returns to its initial position, the bowstring 16 engages the top bolt 28 and propels it out of the crossbow 10.

Figure 10:
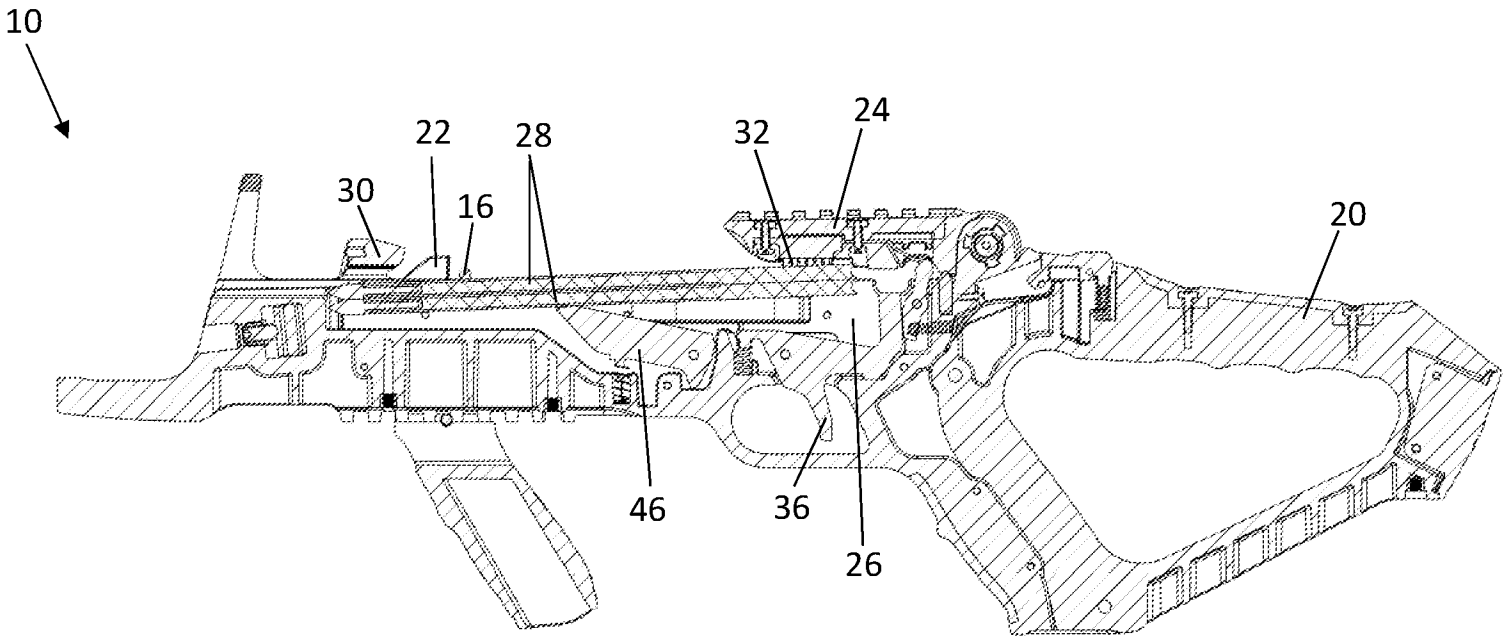
FIG. 10 is a cross-sectional side view of the crossbow depicting the bowstring returned to its un-cocked position after shooting a bolt.

With reference to FIG. 10, the bowstring 16 is positioned at the forward end of the crossbow 10 upon completion of a first shot. The bowstring 16 is positioned at the front of the crossbow 10, and the bolt lever 46 is pressing the leading ends of the bolts 28 against the bowstring 16 and is pressing the trailing ends of the bolts against the retaining brush 32 underneath the trigger hood 24. This position of the crossbow 10 is analogous to the default initial position of crossbow 10 depicted in FIG. 6. At this point, the user can repeat the steps of rotating the cocking lever 20 to its fully rotated position, resulting in the cocking hooks 22 drawing the bowstring 16 back over the remaining bolts 28 housed within chamber 26 and, then, returning the cocking lever 20 to its initial closed position. These steps cock the bowstring 16, move the cocking hooks 22 to the front of the crossbow body 12 and out of the way of the path of travel of the bowstring 16, and bring the next bolt 28 into an alignment with the flight rail 18. Then, the user pulls the trigger 36 to shoot the bolt 28 and repeat this sequence of steps until the chamber 26 is empty, as depicted in FIG. 11.

Figure 11:
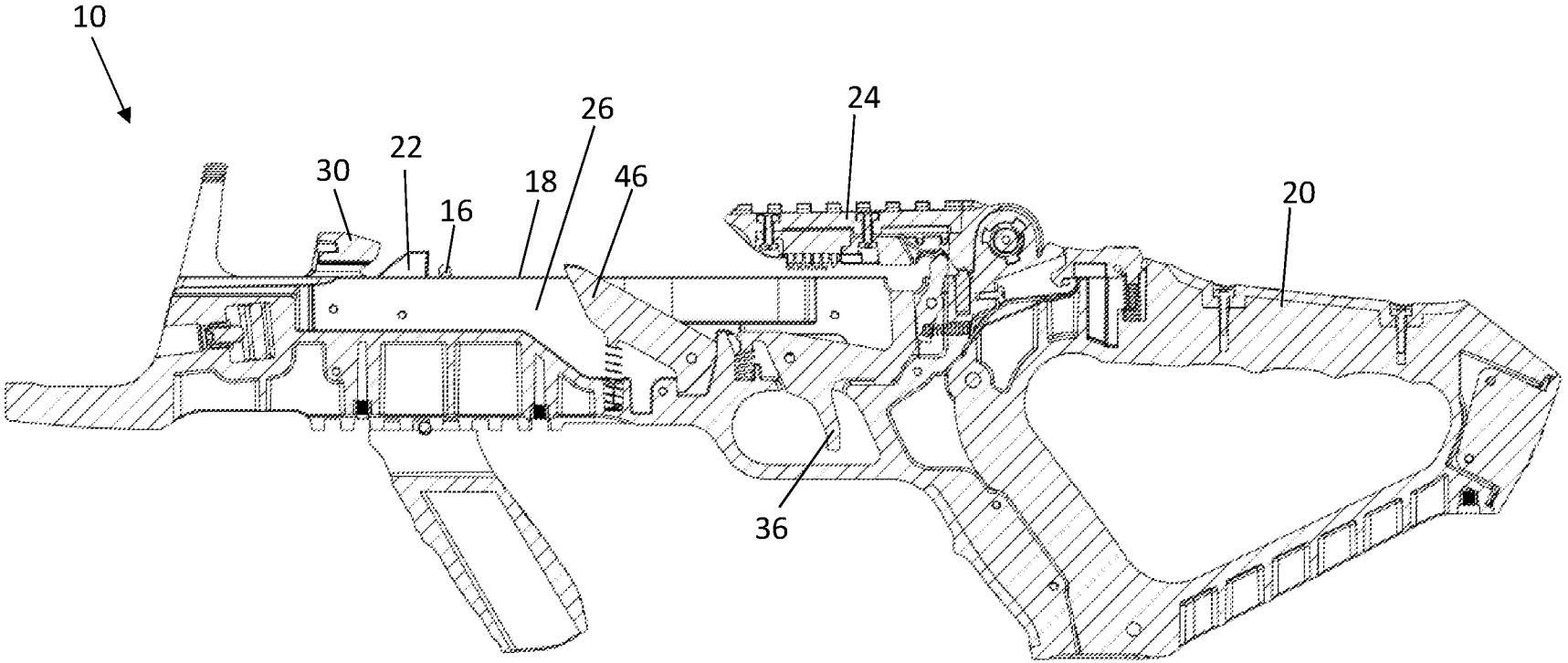
FIG. 11 is a cross-sectional side view of the crossbow depicting the empty loading chamber of the crossbow after all pre-loaded bolts have been shot.
Figure 12:
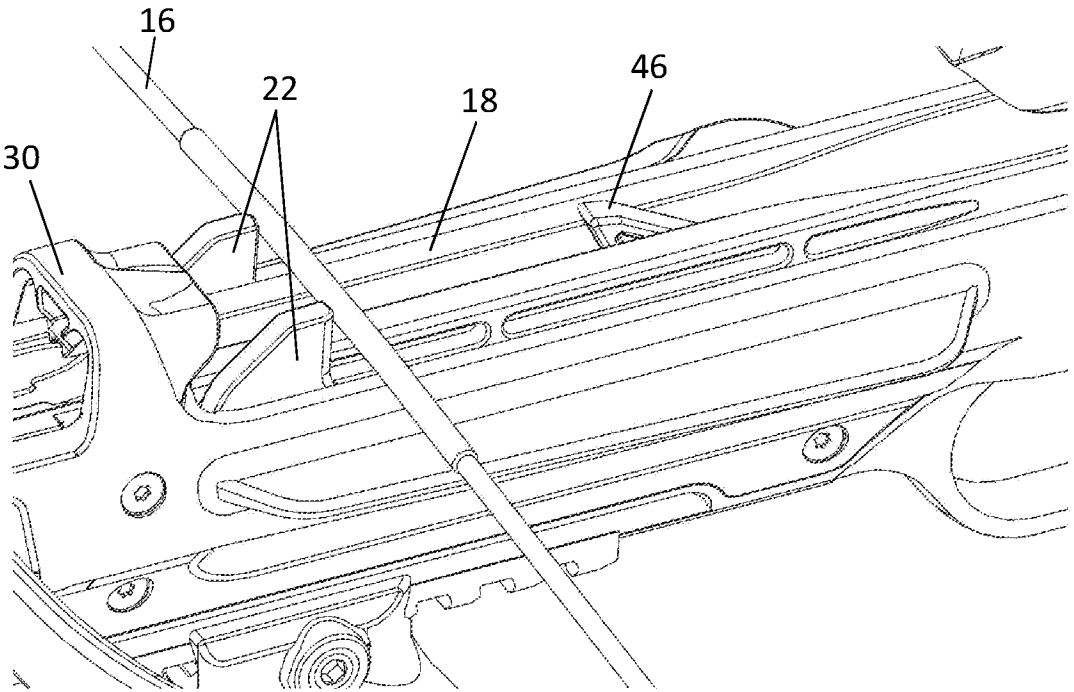
FIG. 12 is a perspective view of the crossbow with a bolt lever protruding onto the flight rail, thereby functioning as an "anti-dry fire" (ADF) mechanism.

Referring now to FIG. 11, when the loading chamber 26 is empty, the bolt lever 46 protrudes beyond the flight rail 18. In this manner, the bolt lever 46 prevents the bowstring 16 from being fully drawn, thereby preventing the user from cocking the crossbow 10 when the chamber 26 is empty. Thus, the bolt lever 46 functions as an anti-dry-fire (ADF) mechanism. FIG. 12 provides a perspective view of the bolt lever 46 protruding past the flight rail 18. The bolt lever 46 protrudes above the flight trail 18 when all bolts 28 have been shot, facing forward, providing a physical obstacle that prevents the bowstring 16 being cocked when no bolts are present. The bolt lever 46 is angled in such a way to act as the ADF.

Figure 13:
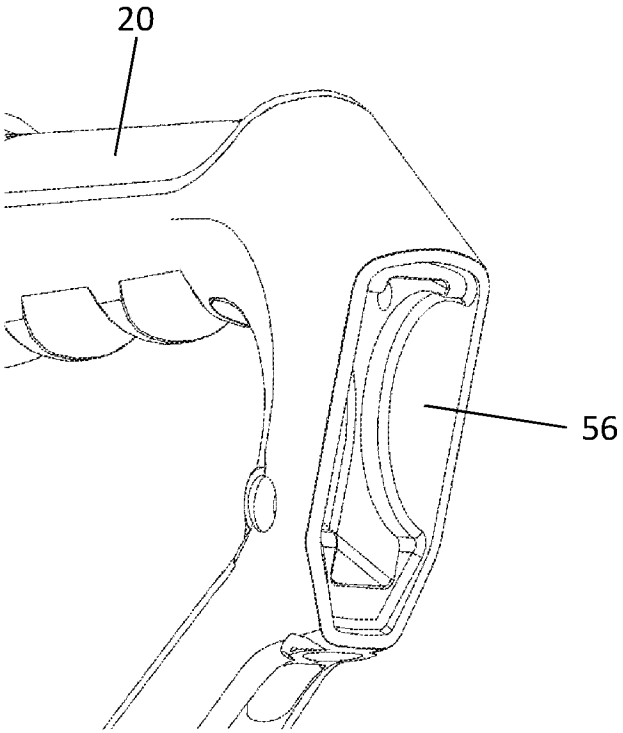
FIG. 13 is perspective view depicting a compartment within the crossbow body configured to house a retractable sling.

With reference to FIG. 13, crossbow 10 may optionally include a retractable carrying sling. The retractable sling includes a cassette that can be positioned within a dedicated compartment 56 within the rear stock (i.e., the cocking lever 20) of the crossbow 10. The cassette has a spring-loaded spool configured to retract the sling into a recess within the rear stock of the crossbow. The retractable sling further includes a locking switch that enables the user to immobilize the spool against retracting the sling into the cassette when the sling is in its deployed position. When the locking switch is engaged, the sling does not automatically retract into the cassette. However, when the locking switch is disengaged, the sling is automatically retracted by being wound onto the spool. With the locking switch disengaged, the sling can be extended out of the cassette. The locking switch can then be re-engaged to lock the sling in position forming a rear shoulder loop.

Each device described in this disclosure may include any combination of the described components, features, and/or functions of each of the individual device embodiments. Each method described in this disclosure may include any combination of the described steps in any order, including the absence of certain described steps and combinations of steps used in separate embodiments. Any range of numeric values disclosed herein includes any subrange therein.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense. While preferred embodiments have been described, it is to be understood that the embodiments are illustrative only and that the scope of the invention is to be defined solely by the appended claims when accorded a full range of equivalents, many variations and modifications naturally occurring to those skilled in the art from a review hereof.

I claim:

1. A crossbow comprising:

a body having a flight rail;

a prod affixed to the body of the crossbow;

a bowstring stretched between a first end and a second end of the prod;

a chamber disposed within the body of the crossbow, the chamber configured to house a projectile;

a biasing mechanism disposed within the chamber, the biasing mechanism configured to apply a force onto the projectile housed within the chamber;

a forward retainer disposed near a front end of the body, the forward retainer configured to retain a leading portion of the projectile in an alignment with the flight rail in response to the force applied on the projectile by the biasing mechanism;

a rearward retainer connected to the body of the crossbow, the rearward retainer configured to retain the trailing portion of the projectile in the alignment with the flight rail in response to the force applied on the projectile by the biasing mechanism when the bowstring is in a cocked position, wherein the rearward retainer includes a trigger hood connected to the body of the crossbow and a retaining member disposed on an underside of the trigger hood, wherein the trigger hood is configured to transition between an open position and a firing position;

wherein the bowstring is configured to travel over the projectile when the bowstring is being drawn toward the cocked position.

2. The crossbow of claim 1, wherein the biasing mechanism includes a bolt lever disposed within the chamber and a biasing element configured to urge the bolt lever in an upward direction.

3. The crossbow of claim 2, wherein in an extended position the bolt lever protrudes beyond the flight rail, wherein in a retracted position the bolt lever is retracted below the flight rail by the projectile housed within the chamber.

4. The crossbow of claim 3, wherein the biasing element urges the bolt lever toward the extended position.

5. The crossbow of claim 1, wherein the chamber is further configured to house more than one projectile.

6. The crossbow of claim 1, wherein the forward retainer includes a retaining bridge.

7. The crossbow of claim 1, wherein in the open position of the trigger hood, an opening of the chamber is sufficiently unobstructed by the trigger hood to permit passage of the projectile into the chamber; and wherein in the firing position, the retaining member of the trigger hood is positioned over the opening of the chamber such that the retaining member immobilizes the trailing portion of the projectile.

8. The crossbow of claim 1, wherein the crossbow is a break action pistol crossbow.

9. The crossbow of claim 8, further comprising a cocking lever and at least one cocking hook operatively connected to the cocking lever; wherein rotating the cocking lever from a closed position to a fully rotated position causes the at least one cocking hook to engage the bowstring and to cock the crossbow.

10. The crossbow of claim 1, further comprising a retractable carrying sling.

11. The crossbow of claim 7, wherein the retaining member is a retaining brush.

12. A crossbow comprising:

a body having a flight rail;

a prod affixed to the body of the crossbow;

a bowstring stretched between a first end and a second end of the prod;

a chamber disposed within the body of the crossbow, the chamber configured to house a projectile;

a bolt lever disposed within the chamber, the bolt lever having an extended position in which the bolt lever protrudes beyond the flight rail and a retracted position in which the bolt lever is retracted below the flight rail by the projectile housed within the chamber;

a biasing element configured to urge the bolt lever toward the extended position, wherein the biasing element causes the bolt lever to apply a force onto the projectile housed within the chamber;

a retaining bridge disposed near a front end of the body, the retaining bridge configured to retain a leading portion of the projectile in an alignment with the flight rail in response to the force applied on the projectile by the bolt lever;

a trigger hood connected to the body of the crossbow, wherein the trigger hood is configured to transition between an open position and a firing position;

a retaining brush disposed on an underside of the trigger hood, the retaining brush configured to retain the trailing portion of the projectile in the alignment with the flight rail in response to the force applied on the projectile by the bolt lever when the bowstring is in a cocked position;

wherein the bowstring is configured to travel over the projectile when the bowstring is being drawn toward the cocked position.

13. The crossbow of claim 12, wherein the chamber is further configured to house more than one projectile.

14. The crossbow of claim 13, wherein in the open position of the trigger hood, an opening of the chamber is sufficiently unobstructed by the trigger hood to permit passage of the projectile into the chamber; and wherein in the firing position, the retaining brush of the trigger hood is positioned over the opening of the chamber such that the retaining brush immobilizes the trailing portion of the projectile.

15. The crossbow of claim 12, wherein the crossbow is a break action pistol crossbow.

16. The crossbow of claim 14, further comprising a cocking lever and at least one cocking hook operatively connected to the cocking lever; wherein rotating the cocking lever from a closed position to a fully rotated position causes the at least one cocking hook to engage the bowstring and to cock the crossbow.

* * * * *